US009694613B2

(12) United States Patent
Tanaka et al.

(10) Patent No.: US 9,694,613 B2
(45) Date of Patent: Jul. 4, 2017

(54) RECORDING MEDIUM

(71) Applicant: CANON KABUSHIKI KAISHA, Tokyo (JP)

(72) Inventors: Arika Tanaka, Yokohama (JP); Ryo Taguri, Sagamihara (JP); Takatoshi Tanaka, Tokyo (JP); Tomokazu Kotake, Tokyo (JP); Takashi Sugiura, Yokohama (JP); Jun Wang, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/861,418

(22) Filed: Sep. 22, 2015

(65) Prior Publication Data

US 2016/0082767 A1 Mar. 24, 2016

(30) Foreign Application Priority Data

Sep. 24, 2014 (JP) ..... 2014-194375

(51) Int. Cl.
*B41M 5/00* (2006.01)
*B41M 5/52* (2006.01)
*B41M 5/50* (2006.01)

(52) U.S. Cl.
CPC ..... *B41M 5/5218* (2013.01); *B41M 5/502* (2013.01); *B41M 5/506* (2013.01); *B41M 5/508* (2013.01); *B41M 5/52* (2013.01); *B41M 2205/38* (2013.01); *B41M 2205/42* (2013.01)

(58) Field of Classification Search
CPC ..... B41M 5/502; B41M 5/506; B41M 5/508; B41M 5/5218
See application file for complete search history.

(56) References Cited

U.S. PATENT DOCUMENTS 6,391,428 B1 * 5/2002 Ueno ..... B41M 5/5218 428/32.31
2002/0193496 A1 * 12/2002 Takehiko ..... B41M 5/5218 524/492
2003/0008115 A1 * 1/2003 Sugiyama ..... B41M 5/502 428/195.1
2003/0113516 A1 * 6/2003 Wang ..... B41M 5/508 428/195.1
2007/0265163 A1 * 11/2007 Date ..... B41M 5/3377 503/207
2008/0273045 A1 * 11/2008 Morohoshi ..... B41M 5/5218 346/135.1
2010/0239773 A1 * 9/2010 Yamaguchi ..... C23C 22/08 427/397.7
2013/0216820 A1 * 8/2013 Riddle ..... C09D 4/00 428/313.9

FOREIGN PATENT DOCUMENTS

| | | | |
|---|---|---|---|
| EP | 0997314 | A1 | 5/2000 |
| EP | 1329330 | A1 | 7/2003 |
| EP | 1842687 | A1 | 10/2007 |
| EP | 2138320 | A1 | 12/2009 |
| JP | H07-232473 | A | 9/1995 |
| JP | H08-132731 | A | 5/1996 |
| JP | H09-066664 | A | 3/1997 |
| JP | H09-076628 | A | 3/1997 |
| JP | 2000037944 | A | 2/2000 |
| JP | 2002274021 | A | 9/2002 |
| JP | 2002362008 | A | 12/2002 |
| JP | 2003-291483 | A | 10/2003 |
| JP | 2005212263 | A | 8/2005 |
| JP | 2005231295 | A | 9/2005 |
| JP | 2006-062228 | A | 3/2006 |
| JP | 2006264278 | A | 10/2006 |
| JP | 2007-118529 | A | 5/2007 |
| JP | 2007-223306 | A | 9/2007 |
| JP | 2007245426 | A | 9/2007 |
| JP | 2008246983 | A | 10/2008 |
| JP | 2012-213924 | A | 11/2012 |

OTHER PUBLICATIONS

U.S. Appl. No. 14/860,920, filed Sep. 22, 2015.
U.S. Appl. No. 14/861,329, filed Sep. 22, 2015.

* cited by examiner

*Primary Examiner* — Betelhem Shewareged
(74) *Attorney, Agent, or Firm* — Canon U.S.A. Inc., IP Division

(57) ABSTRACT

A recording medium includes a substrate, a first ink-receiving layer, and a second ink-receiving layer serving as a top layer in this order. The first ink-receiving layer contains an amorphous silica having an average particle size of 1.0 μm or more. The second ink-receiving layer contains a colloidal silica. The root-mean-square slope RΔq of roughness profile elements, provided in JIS B 0601:2001, of a surface of the second ink-receiving layer is 0.3 or more.

10 Claims, No Drawings

RECORDING MEDIUM

BACKGROUND OF THE INVENTION

Field of the Invention

The present invention relates to a recording medium.

Description of the Related Art

Among recording media used in an ink jet image recording method, recording media (matte paper) whose surface has low gloss, that is, whose surface has a good "matte appearance" have been demanded. On the other hand, if particles having a large particle size are simply added to an ink-receiving layer to achieve a good matte appearance, the binding property of the ink-receiving layer may degrade, that is, a dusting phenomenon may occur. Therefore, a method for achieving a good matte appearance and suppressing a dusting phenomenon has been demanded.

Japanese Patent Laid-Open No. 2007-118529 discloses that the surface strength is improved by a cast method in which an ink-receiving layer constituted by at least two layers and disposed on an air-permeable substrate is moistened again using a moistening liquid containing a colloidal silica having an average particle size of 40 nm or less and is pressed against a heated drum to transfer a specular surface.

SUMMARY OF THE INVENTION

A recording medium according to an aspect of the present invention includes a substrate, a first ink-receiving layer, and a second ink-receiving layer serving as a top layer in this order, wherein the first ink-receiving layer contains an amorphous silica having an average particle size of 1.0 μm or more, and the second ink-receiving layer contains a colloidal silica, and a root-mean-square slope RΔq of roughness profile elements, provided in JIS B 0601:2001, of a surface of the second ink-receiving layer is 0.3 or more.

Further features of the present invention will become apparent from the following description of exemplary embodiments.

DESCRIPTION OF THE EMBODIMENTS

According to studies conducted by the present inventors on the recording medium disclosed in Japanese Patent Laid-Open No. 2007-118529, a dusting phenomenon is suppressed, but the matte appearance is not sufficiently achieved. Accordingly, the present invention is directed to providing a recording medium which has a matte appearance and in which a dusting phenomenon is suppressed.

Hereafter, the present invention will be described in detail using embodiments.

First, the "matte appearance" according to an embodiment of the present invention will be described. A recording medium having a matte appearance refers to a recording medium having small surface reflection and having small gloss even when viewed at any angle. More specifically, the recording medium having a matte appearance refers to a recording medium in which all the 20° glossiness, 60° glossiness, and 75° glossiness of the surface are less than 6.0%.

As a result of studies conducted by the present inventors on the relationship between the surface roughness and matte appearance of the recording medium, it has been found that the root-mean-square slope RΔq of roughness profile elements, provided in JIS B 0601:2001, of the surface (i.e., the surface of a top layer) of the recording medium needs to be 0.3 or more. The root-mean-square slope RΔq indicates the degree of slopes of irregularities. A large value of RΔq means that the slopes of irregularities are steep. It is believed that a matte appearance is achieved due to such a surface profile because incident light tends to be scattered as the slopes of irregularities increase and thus the light amount in the direction of specular reflection is reduced.

According to further studies conducted by the present inventors, it has been found that, when an ink-receiving layer disposed on a substrate is constituted by at least two layers, a first ink-receiving layer serving as a lower layer contains an amorphous silica having an average particle size of 1.0 μm or more, a second ink-receiving layer serving as a top layer contains a colloidal silica, and the root-mean-square slope RΔq of the surface of the second ink-receiving layer is 0.3 or more, a dusting phenomenon can be suppressed while a matte appearance is maintained.

Recording Medium

The recording medium according to an embodiment of the present invention includes a substrate, a first ink-receiving layer, and a second ink-receiving layer serving as a top layer in this order. As long as the advantages according to an embodiment of the present invention are achieved, another layer may be disposed between the substrate and the first ink-receiving layer or between the first ink-receiving layer and the second ink-receiving layer. The recording medium according to an embodiment of the present invention is particularly a recording medium used in an ink jet recording method, that is, an ink jet recording medium. Hereafter, each component of the recording medium according to an embodiment of the present invention will be described.

Substrate

The substrate is, for example, a substrate composed of only a base paper or a substrate including a base paper and a resin layer, that is, a substrate including a base paper coated with a resin. In an embodiment of the present invention, a substrate including a base paper and a resin layer, that is, a resin-coated substrate can be used. In this case, the resin layer may be disposed on only one surface of the base paper, but is desirably disposed on both surfaces of the base paper.

The base paper is mainly made of wood pulp and optionally contains synthetic pulp such as polypropylene and synthetic fiber such as nylon or polyester. Examples of the wood pulp include laubholz bleached kraft pulp (LBKP), laubholz bleached sulfite pulp (LBSP), nadelholz bleached kraft pulp (NBKP), nadelholz bleached sulfite pulp (NBSP), laubholz dissolving pulp (LDP), nadelholz dissolving pulp (NDP), laubholz unbleached kraft pulp (LUKP), and nadelholz unbleached kraft pulp (NUKP). They may be suitably used alone or in combination of two or more. Among the wood pulps, LBKP, NBSP, LBSP, NDP, and LDP which contain a large amount of short staple components are particularly used. The pulp is particularly a chemical pulp (sulfate pulp or sulfite pulp) containing only a small amount of impurities. A pulp whose degree of whiteness is improved by performing a bleaching treatment can also be used. The paper substrate may suitably contain a sizing agent, a white pigment, a paper strengthening agent, a fluorescent brightening agent, a water-retaining agent, a dispersant, a softening agent, and the like.

In an embodiment of the present invention, the paper density of the base paper provided in JIS P 8118 is preferably 0.6 g/cm$^3$ or more and 1.2 g/cm$^3$ or less and more preferably 0.7 g/cm$^3$ or more and 1.2 g/cm$^3$ or less.

In an embodiment of the present invention, when the substrate includes a resin layer, the thickness of the resin layer is, for example, 10 μm or more and 60 μm or less. In an embodiment of the present invention, the thickness of the resin layer is calculated by the following method. The cross-section of the recording medium is exposed by cutting the recording medium using a microtome, and the cross-section is observed with a scanning electron microscope. The thickness of the resin layer is measured at freely selected 100 points or more, and the average of the thicknesses is defined as a thickness of the resin layer. In an embodiment of the present invention, the thickness of other layers is also calculated by the same method.

A resin used for the resin layer is, for example, a thermoplastic resin. Examples of the thermoplastic resin include acrylic resin, acrylic silicone resin, polyolefin resin, and styrene-butadiene copolymers. Among them, a polyolefin resin is particularly used. In an embodiment of the present invention, the polyolefin resin refers to a polymer that uses an olefin as a monomer. Specific examples of the olefin resin include polymers and copolymers of ethylene, propylene, isobutylene, and the like. The polyolefin resins may be suitably used alone or in combination of two or more. Among them, polyethylene is particularly used. The polyethylene is, for example, a low-density polyethylene (LDPE) and a high-density polyethylene (HDPE). The resin layer may contain, for example, a white pigment, a fluorescent brightening agent, and ultramarine blue to control the opacity, the degree of whiteness, and the hue. Among them, a white pigment can be contained to improve the opacity. Examples of the white pigment include a rutile titanium oxide and an anatase titanium oxide.

In an embodiment of the present invention, the root-mean-square slope RΔq of roughness profile elements, provided in JIS B 0601:2001, of the surface of the substrate on the first ink-receiving layer side is preferably 0.1 or more and more preferably 0.3 or more. The root-mean-square slope RΔq is preferably 2.0 or less and more preferably 1.0 or less.

Ink-Receiving Layer

In an embodiment of the present invention, the ink-receiving layer may be disposed on only one surface or both surfaces of the substrate. The thickness of the ink-receiving layer is, for example, 18.0 μm or more and 55.0 μm or less. In an embodiment of the present invention, the ink-receiving layer may be constituted by two layers or three or more layers. In an embodiment of the present invention, the dry coating amount of the ink-receiving layer is preferably 18.0 $g/m^2$ or more and 55.0 $g/m^2$ or less and more preferably 18.0 $g/m^2$ or more and 50.0 $g/m^2$ or less. When the ink-receiving layer is constituted by a plurality of layers, the dry coating amount of the ink-receiving layer refers to a total dry coating amount of all the layers. Hereafter, materials that can be contained in the ink-receiving layer will be described.

First Ink-Receiving Layer

In an embodiment of the present invention, the first ink-receiving layer contains an amorphous silica having an average particle size of 1.0 μm or more.

(1) Amorphous Silica Having Average Particle Size of 1.0 μm or More

In an embodiment of the present invention, the average particle size of the amorphous silica is preferably 1.0 μm or more and 15.0 μm or less and more preferably 1.0 μm or more and 8.0 μm or less. In an embodiment of the present invention, the average particle size refers to an average of diameters of particles having a maximum unit recognized as a particle when the cross-section of the recording medium is observed with a scanning electron microscope (SEM). More specifically, the cross-section of the recording medium is observed with a scanning electron microscope (SEM), the diameters of freely selected 100 particles are measured, and the number average of the diameters is calculated. In the amorphous silica, secondary particles formed by association of primary particles are observed. Therefore, the "average particle size of the amorphous silica" refers to an "average secondary particle size of the amorphous silica". The primary particle size of the amorphous silica is preferably 1 nm or more and 80 nm or less and more preferably 2 nm or more and 70 nm or less. If the primary particle size is less than 1 nm, the ink absorbency may degrade. If the primary particle size is more than 80 nm, the color development may degrade.

The amorphous silica refers to particles containing 93% or more of $SiO_2$, about 5% or less of $Al_2O_3$, and about 5% or less of $Na_2O$ on a dry weight basis, such as so-called white carbon, silica gel, and porous synthetic amorphous silica. The production method for porous synthetic amorphous silica is classified into a dry process and a wet process, and the dry process is classified into a combustion process and a heating process. The wet process is classified into a precipitation process and a gel process. The dry combustion process is also generally called a vapor-phase process in which a mixture of vaporized silicon tetrachloride and hydrogen is subjected to combustion in the air at 1,600 to 2,000° C. The wet precipitation process is normally a process in which sodium silicate, sulfuric acid, and the like are reacted with each other in an aqueous solution to precipitate $SiO_2$. In this process, the specific surface area, primary particle size, and the like of silica can be controlled in accordance with, for example, the reaction temperature and the addition rate of an acid. The secondary particle size and the physical properties of silica subtly changes in accordance with drying and crushing conditions. The wet gel process is generally a production process in which sodium silicate and sulfuric acid are reacted with each other by simultaneous addition or the like. In the case of silica particles, for example, a three-dimensional hydrogel structure is obtained through dehydration condensation of silanol groups. The feature of the wet gel process is that secondary particles having a large specific surface area can be formed because the hydrogel structure includes relatively small primary particles. Therefore, the size of the primary particles is controlled by changing the reaction conditions or the like, and thus secondary particle sizes having different oil absorptions can be achieved. In an embodiment of the present invention, one type of amorphous silica or two types or more of amorphous silicas may be contained. In an embodiment of the present invention, the amorphous silica is, for example, a wet-process silica. Moreover, inorganic particles other than the amorphous silica may be further contained.

(2) Binder

In an embodiment of the present invention, the first ink-receiving layer can further contain a binder. In an embodiment of the present invention, the binder is a material capable of binding inorganic particles.

In an embodiment of the present invention, the content of the binder in the first ink-receiving layer is preferably 5.0 mass % or more and 60.0 mass % or less and more preferably 7.5 mass % or more and 50.0 mass % or less based on the content of the inorganic particles. If the content is less than 5.0 mass %, a dusting phenomenon is sometimes not sufficiently suppressed. If the content is more than 60.0 mass %, the ink absorbency of the recording medium is sometimes not sufficiently achieved.

Examples of the binder include starch derivatives such as oxidized starch, etherified starch, and phosphoesterified starch; cellulose derivatives such as carboxymethyl cellulose and hydroxyethyl cellulose; casein, gelatin, soy protein, and polyvinyl alcohol and derivatives thereof; conjugated polymer latexes such as polyvinylpyrrolidone, maleic anhydride resin, styrene-butadiene copolymers, and methyl methacrylate-butadiene copolymers; acrylic polymer latexes such as polymers of acrylates and methacrylates; vinyl polymer latexes such as ethylene-vinyl acetate copolymers; functional group-modified polymer latexes constituted by a monomer of the above-described polymer, the monomer containing a functional group such as a carboxy group; polymers obtained by cationizing the above-described polymer using a cationic group; polymers obtained by cationizing the surface of the above-described polymer using a cationic surfactant; polymers obtained by polymerizing a monomer of the above-described polymer in the presence of a cationic polyvinyl alcohol to distribute the polyvinyl alcohol on the surface of the polymer; polymers obtained by polymerizing a monomer of the above-described polymer in a suspended dispersion liquid of cationic colloidal particles to distribute the cationic colloidal particles on the surface of the polymer; water-based binders such as thermosetting synthetic resin, e.g., melamine resin and urea resin; polymers and copolymers of acrylates and methacrylates, such as polymethyl methacrylate; and synthetic resin such as polyurethane resin, unsaturated polyester resin, vinyl chloride-vinyl acetate copolymers, polyvinyl butyral, and alkyd resin. These binders may be suitably used alone or in combination of two or more.

Among the binders, polyvinyl alcohol and polyvinyl alcohol derivatives are particularly used. Examples of the polyvinyl alcohol derivatives include cationically modified polyvinyl alcohols, anionically modified polyvinyl alcohols, silanol-modified polyvinyl alcohols, and polyvinyl acetal. Among them, polyvinyl alcohol is particularly used in terms of the stability of a coating liquid. Specific examples of the polyvinyl alcohol include PVA235, PVA245, and PVA145 (manufactured by KURARAY Co., Ltd.).

The polyvinyl alcohol can be synthesized by, for example, saponifying polyvinyl acetate. The degree of saponification of the polyvinyl alcohol is preferably 80 mol % or more and 100 mol % or less and more preferably 85 mol % or more and 100 mol % or less. The degree of saponification refers to the mol percent of hydroxy groups generated as a result of a saponification reaction in which polyvinyl alcohol is obtained by saponifying polyvinyl acetate. In an embodiment of the present invention, the degree of saponification is measured in conformity with the method in JIS K 6726. The average degree of polymerization of the polyvinyl alcohol is preferably 1,500 or more and 5,000 or less and more preferably 2,000 or more and 5,000 or less. In an embodiment of the present invention, the average degree of polymerization is a viscosity-average degree of polymerization determined in conformity with the method in JIS K 6726.

When an ink-receiving-layer-forming coating liquid is prepared, the polyvinyl alcohol or the polyvinyl alcohol derivative is used, for example, in the form of an aqueous solution. The solid content of the polyvinyl alcohol or the polyvinyl alcohol derivative in the aqueous solution is, for example, 3 mass % or more and 20 mass % or less.

(3) Other Additives

In an embodiment of the present invention, the first ink-receiving layer may contain additives other than the above-described additives. Specific examples of the additives include a cross-linking agent, a pH adjusting agent, a thickener, a flow modifier, an antifoaming agent, a foam inhibitor, a surfactant, a mold-release agent, a penetrant, a color pigment, a color dye, a fluorescent brightening agent, an ultraviolet absorber, an antioxidant, a preservative, a fungicide, a water resistance improver, a dye fixative, a curing agent, and a weather resistant material.

Second Ink-Receiving Layer

In an embodiment of the present invention, the second ink-receiving layer serving as a top layer contains a colloidal silica, and the root-mean-square slope RΔq of roughness profile elements, provided in JIS B 0601:2001, of the surface of the second ink-receiving layer is 0.3 or more and preferably 0.35 or more.

The coating amount of the top layer is preferably 0.2 $g/m^2$ or more and 3.0 $g/m^2$ or less and more preferably 0.2 $g/m^2$ or more and 2.0 $g/m^2$ or less. If the coating amount is less than 0.2 $g/m^2$, an effect of improving the binding property of the ink-receiving layer is sometimes not sufficiently produced. If the coating amount is more than 3.0 $g/m^2$, an effect of improving the matte appearance is sometimes not sufficiently produced. The coating thickness of the top layer is preferably 0.2 μm or more and 3.0 μm or less and more preferably 0.2 μm or more and 2.0 μm or less. The root-mean-square slope RΔq of roughness profile elements, provided in JIS B 0601:2001, of the surface of the top layer is, for example, 0.3 or more. If the root-mean-square slope RΔq is less than 0.3, an effect of improving the matte appearance is sometimes not sufficiently produced.

In an embodiment of the present invention, spherical colloidal silica is particularly used because an effect of suppressing a dusting phenomenon is highly produced, and the transparency is improved and thus the color development of an image is improved. The term "spherical" used herein means that, when 50 or more and 100 or less colloidal silica particles are observed with a scanning electron microscope, the ratio b/a of the average minor axis b to the average major axis a of the colloidal silica particles is in the range of 0.80 or more and 1.00 or less. The ratio b/a is preferably 0.90 or more and 1.00 or less and more preferably 0.95 or more and 1.00 or less. Furthermore, spherical cationic colloidal silica is particularly used. Specific examples of the spherical cationic colloidal silica include SNOWTEX AK and SNOWTEX AK-L (manufactured by Nissan Chemical Industries, Ltd.).

The average primary particle size of the colloidal silica is, for example, 30 nm or more and 100 nm or less. If the average particle size is less than 30 nm, an effect of improving ink absorbency is sometimes not sufficiently produced. If the average particle size is more than 100 nm, the range of RΔq is sometimes not satisfied, and the transparency degrades and an effect of improving the color development of an image formed is sometimes not sufficiently produced.

The second ink-receiving layer may contain a binder and other additives. The same binder and additives as those exemplified in the description of the first ink-receiving layer can be used.

The second ink-receiving layer may contain other inorganic particles such as an amorphous silica having an average secondary particle size of 1.0 μm or more. In this case, the content of the colloidal silica is preferably 70.0 mass % or more and more preferably 80.0 mass % or more based on the content of the inorganic particles in the top layer. Method for producing recording medium In an embodiment of the present invention, a method for producing a recording medium is not particularly limited, but desirably includes a step of preparing an ink-receiving-layer-forming coating liquid and a step of applying the ink-receiving-layer-forming coating liquid onto a substrate.

Hereafter, the method for producing a recording medium will be described.

Method for Making Substrate

In an embodiment of the present invention, the base paper can be made by a typically used paper-making method. A paper machine is, for example, a Fourdrinier machine, a cylinder machine, a drum paper machine, a twin-wire former, or the like. In order to improve the surface smoothness of the base paper, a surface treatment may be performed by applying heat and a pressure during or after the paper-making process. Specific examples of the surface treatment include a calender treatment such as machine calendering or supercalendering.

A method for forming a resin layer on a base paper, that is, a method for coating a base paper with a resin may be a melt extrusion method, wet lamination, or dry lamination. Among these methods, a melt extrusion method is particularly employed in which a molten resin is extruded on one surface or both surfaces of a base paper to coat the base paper with the resin. An example of a widely employed method is a method (also referred to as an "extrusion coating method") including bringing a resin extruded from an extrusion die into contact with a conveyed base paper at a nip point between a nip roller and a cooling roller, and pressure-bonding the resin and the base paper with a nip to laminate the base paper with a resin layer. In the formation of a resin layer by the melt extrusion method, a pretreatment may be conducted so that the base paper and the resin layer more firmly adhere to each other. Examples of the pretreatment include an acid etching treatment with a mixture of sulfuric acid and chromic acid, a flame treatment with a gas flame, an ultraviolet irradiation treatment, a corona discharge treatment, a glow discharge treatment, and an anchor coating treatment with an alkyl titanate or the like. Among these pretreatments, a corona discharge treatment is particularly employed.

By pressing a surface of the resin-coated substrate against a roll having particular irregularities, the surface profile of the resin-coated paper can be controlled.

Method for Forming Ink-Receiving Layer

An ink-receiving layer of a recording medium according to an embodiment of the present invention can be formed on a substrate by, for example, the following method. First, an ink-receiving-layer-forming coating liquid is prepared. Then, the coating liquid is applied onto a substrate and dried to produce a recording medium according to an embodiment of the present invention. The coating liquid can be applied with a curtain coater, an extrusion coater, or a slide hopper coater. The coating liquid may be heated during the application. The coating liquid may be dried using a hot-air dryer such as a linear tunnel dryer, an arch dryer, an air loop dryer, or a sine-curve air float dryer; or an infrared dryer, a heating dryer, or a microwave dryer.

Examples

Hereafter, the present invention will be further described in detail using Examples and Comparative Examples. The present invention is not limited to Examples described below as long as it does not exceed the gist of the present invention. Note that the term "part" in the description of Examples below is on a mass basis unless otherwise specified.

Production of Recording Medium

Preparation of Substrate

Eighty parts of LBKP having a Canadian Standard Freeness of 450 mL CSF, 20 parts of NBKP having a Canadian Standard Freeness of 480 mL CSF, 0.60 parts of cationized starch, 10 parts of heavy calcium carbonate, 15 parts of light calcium carbonate, 0.10 parts of an alkyl ketene dimer, and 0.030 parts of cationic polyacrylamide were mixed with each other. Water was added to the resulting mixture such that the mixture had a solid content of 3.0 mass %, thereby preparing a paper material. Subsequently, the paper material was subjected to paper making with a Fourdrinier machine and three-stage wet pressing, followed by drying with a multi-cylinder dryer. The resulting paper was then impregnated with an aqueous solution of oxidized starch using a size press machine so as to have a solid content of 1.0 g/m$^2$ after drying, and then dried. Furthermore, the paper was subjected to machine calender finishing, thus preparing a base paper having a basis weight of 110 g/m$^2$, a Stockigt sizing degree of 100 seconds, an air permeability of 50 seconds, a Bekk smoothness of 30 seconds, a Gurley stiffness of 11.0 mN, and a thickness of 120 μm. Subsequently, a resin composition containing 70 parts of low-density polyethylene, 20 parts of high-density polyethylene, and 10 parts of titanium oxide was applied onto one surface of the base paper such that the dry coating amount was 25 g/m$^2$. This surface is referred to as a "main surface" of a substrate. By pressing the main surface against a roll having fine irregularities, RΔq of the surface of the resin-coated paper was adjusted to 0.4. Furthermore, a resin composition containing 50 parts of low-density polyethylene and 50 parts of high-density polyethylene was applied onto another surface of the base paper to prepare a substrate.

Preparation of First-Ink-Receiving-Layer-Forming Coating Liquid

Amorphous silica (wet silica) was added to ion-exchanged water so as to have a solid content of 25 mass %. Subsequently, 5.0 parts of polydiallyldimethylammonium chloride polymer was added to 100 parts of the amorphous silica in terms of solid content, and stirring was performed. Furthermore, ion-exchanged water was added thereto so that the solid content of the amorphous silica was 21 mass %. Thus, an amorphous silica dispersion liquid was prepared.

The prepared amorphous silica dispersion liquid and a binder aqueous solution were mixed with each other at a solid content ratio (amorphous silica:polyvinyl alcohol) listed in Table 1 to prepare a second-ink-receiving-layer-forming coating liquid. In the type of binder in Table 1, "R-1130" represents a silanol-modified polyvinyl alcohol aqueous solution (prepared by adjusting the solid content of R-1130 (manufactured by KURARAY Co., Ltd.) to 8 mass %) and "PVA235" represents a polyvinyl alcohol aqueous solution (prepared by adjusting the solid content of PVA235 (manufactured by KURARAY Co., Ltd.) to 8 mass %). Table 1 also shows the average particle size of the amorphous silica measured by the above-described method.

TABLE 1

Preparation conditions of first-ink-receiving-layer-forming coating liquid

| Coating liquid No. | Average particle size of amorphous silica (μm) | Type of binder | Ratio (amorphous silica:binder) |
|---|---|---|---|
| Coating liquid 1-1 | 0.50 | R-1130 | 100:40 |
| Coating liquid 1-2 | 1.20 | R-1130 | 100:40 |
| Coating liquid 1-3 | 8.80 | R-1130 | 100:40 |

TABLE 1-continued

Preparation conditions of first-ink-receiving-layer-forming coating liquid

| Coating liquid No. | Average particle size of amorphous silica (μm) | Type of binder | Ratio (amorphous silica:binder) |
|---|---|---|---|
| Coating liquid 1-4 | 0.50 | PVA235 | 100:15 |
| Coating liquid 1-5 | 1.20 | PVA235 | 100:15 |
| Coating liquid 1-6 | 8.80 | PVA235 | 100:15 |

Preparation of Second-Ink-Receiving-Layer-Forming Coating Liquid

A colloidal silica dispersion liquid (SNOWTEX AK-L, manufactured by Nissan Chemical Industries, Ltd.) having an average particle size of 45 nm, a silanol-modified polyvinyl alcohol aqueous solution (solid content of R-1130 (manufactured by KURARAY Co., Ltd.): 8 mass %), and a boric acid aqueous solution (solid content: 3 mass %) were mixed with each other at a solid content ratio (amorphous silica:polyvinyl alcohol:boric acid) of 100:11:1.2 to prepare a second-ink-receiving-layer-forming coating liquid.

Production of Recording Medium

The prepared first-ink-receiving-layer-forming coating liquid and the prepared second-ink-receiving-layer-forming coating liquid (temperature of each coating liquid: 40° C.) were subjected to simultaneous multilayer application onto a substrate using a slide die at a dry coating amount (g/m$^2$) listed in Table 2 and dried with hot air at 150° C. to produce a recording medium.

The root-mean-square slope RΔq of roughness profile elements of the surface of the produced recording medium was measured with a Surfcorder SE3500 (manufactured by Kosaka Laboratory Ltd.) in conformity with JIS B 0601: 2001. Table 2 shows the results.

Evaluation

Matte Appearance of Surface of Recording Medium

The specular glossiness, provided in JIS Z 8741, of the produced recording medium was measured at 20°, 60°, and 75° using a gloss meter VG2000 (manufactured by Nippon Denshoku Industries Co., Ltd.). The measurement was performed at freely selected five points on the surface of the recording medium, and the average was calculated. The matte appearance on the surface of the recording medium was evaluated from the measured specular glossiness. The evaluation criteria are as follows. Table 2 shows the evaluation results.

AA: The maximum specular glossiness at 20°, 60°, and 75° was less than 2.6%.

A: The maximum specular glossiness at 20°, 60°, and 75° was 2.6% or more and less than 3.5%.

B: The maximum specular glossiness at 20°, 60°, and 75° was 3.5% or more and less than 6.0%.

C: The maximum specular glossiness at 20°, 60°, and 75° was 6.0% or more.

Binding Property of Ink-Receiving Layer

A black sheet was placed on the produced recording medium. The black sheet was pulled by 10 cm at a constant speed while a load of 15 g/cm$^2$ was applied to the black sheet. The adhesion amount of powder to the black sheet was evaluated as a residual percentage of the black optical density of the black sheet ((black optical density before powder adhesion−black optical density after powder adhesion)/black optical density before powder adhesion). The optical density was measured with an optical reflection densitometer (trade name: 530 spectro-densitometer, manufactured by X-Rite). The binding property of the ink-receiving layer of the recording medium was evaluated from the measured residual percentage of the optical density. The evaluation criteria are as follows. Table 2 shows the evaluation results.

A: The residual percentage of the optical density was more than 90%.

B: The residual percentage of the optical density was more than 75% and 90% or less.

C: The residual percentage of the optical density was 75% or less.

TABLE 2

Production conditions and evaluation results of recording medium

| Example No. | Recording medium No. | First ink-receiving layer: Type of coating liquid | First ink-receiving layer: Coating amount (g/m$^2$) | Second ink-receiving layer: Type of coating liquid | Second ink-receiving layer: Coating amount (g/m$^2$) | Second ink-receiving layer: Coating thickness (μm) | RΔq of surface of second ink-receiving layer | Evaluation results: Matte appearance of surface of recording medium | Evaluation results: Binding property of ink-receiving layer |
|---|---|---|---|---|---|---|---|---|---|
| Example 1 | Recording medium 1 | Coating liquid 1-2 | 20.0 | Coating liquid 2-1 | 1.0 | 1.0 | 0.30 | A | A |
| Example 2 | Recording medium 2 | Coating liquid 1-3 | 20.0 | Coating liquid 2-1 | 1.0 | 1.0 | 0.40 | AA | A |
| Example 3 | Recording medium 3 | Coating liquid 1-3 | 20.0 | Coating liquid 2-1 | 2.0 | 2.0 | 0.35 | AA | A |
| Example 4 | Recording medium 4 | Coating liquid 1-3 | 20.0 | Coating liquid 2-1 | 3.0 | 3.0 | 0.30 | A | A |
| Comparative Example 1 | Recording medium 5 | Coating liquid 1-1 | 20.0 | Coating liquid 2-1 | 1.0 | 1.0 | 0.10 | C | A |
| Comparative Example 2 | Recording medium 6 | Coating liquid 1-3 | 20.0 | — | — | — | 0.70 | AA | C |
| Comparative Example 3 | Recording medium 7 | Coating liquid 1-3 | 20.0 | Coating liquid 2-2 | 1.0 | 1.0 | 0.70 | AA | C |
| Example 5 | Recording medium 8 | Coating liquid 1-5 | 20.0 | Coating liquid 2-1 | 1.0 | 1.0 | 0.30 | A | A |
| Example 6 | Recording medium 9 | Coating liquid 1-6 | 20.0 | Coating liquid 2-1 | 1.0 | 1.0 | 0.40 | AA | A |
| Example 7 | Recording medium 10 | Coating liquid 1-6 | 20.0 | Coating liquid 2-1 | 2.0 | 2.0 | 0.35 | AA | A |

TABLE 2-continued

| Production conditions and evaluation results of recording medium | | | | | | | | | |
|---|---|---|---|---|---|---|---|---|---|
| | | | | | | | | Evaluation results | |
| | | First ink-receiving layer | | Second ink-receiving layer | | | RΔq of surface of | Matte appearance | Binding property |
| Example No. | Recording medium No. | Type of coating liquid | Coating amount ($g/m^2$) | Type of coating liquid | Coating amount ($g/m^2$) | Coating thickness (μm) | second ink-receiving layer | of surface of recording medium | of ink-receiving layer |
| Example 8 | Recording medium 11 | Coating liquid 1-6 | 20.0 | Coating liquid 2-1 | 3.0 | 3.0 | 0.30 | A | A |
| Comparative Example 4 | Recording medium 12 | Coating liquid 1-4 | 20.0 | Coating liquid 2-1 | 1.0 | 1.0 | 0.10 | C | A |
| Comparative Example 5 | Recording medium 13 | Coating liquid 1-6 | 20.0 | — | — | — | 0.70 | AA | C |
| Comparative Example 6 | Recording medium 14 | Coating liquid 1-6 | 20.0 | Coating liquid 2-2 | 1.0 | 1.0 | 0.70 | AA | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-194375, filed Sep. 24, 2014, which is hereby incorporated by reference herein in its entirety.

What is claimed is:

1. A recording medium comprising:

a substrate;

a first ink-receiving layer; and a second ink-receiving layer serving as a top layer in this order, wherein the first ink-receiving layer comprises an amorphous silica having an average particle size of 1.0 μm or more, the second ink-receiving layer comprises a colloidal silica having an average particle size of 30 nm to 100 nm, a coating amount of the second ink-receiving layer is 0.2 $g/m^2$ or more and 3.0 $g/m^2$ or less, and a root-mean-square slope RΔq of roughness profile elements of a surface of the second ink-receiving layer is 0.3 or more.

2. The recording medium according to claim 1, wherein the substrate is a resin-coated substrate.

3. The recording medium according to claim 1, wherein the amorphous silica is a wet-process silica.

4. The recording medium according to claim 1, wherein the second ink-receiving layer has a thickness of 0.2 μm or more and 3.0 μm or less.

5. The recording medium according to claim 1, having a 20° surface glossiness of less than 6.0%, a 60° surface glossiness of less than 6.0%, and a 75° surface glossiness of less than 6.0%.

6. The recording medium according to claim 1, having a 20° surface glossiness of less than 3.5%, a 60° surface glossiness of less than 3.5%, and a 75° surface glossiness of less than 3.5%.

7. The recording medium according to claim 1, wherein the amorphous silica has an average particle size of 1.0 μm to 8.0 μm.

8. The recording medium according to claim 1, wherein the colloidal silica is spherical.

9. The recording medium according to claim 1, wherein the root-mean-square slope RΔq of roughness profile elements of the surface of the second ink-receiving layer is 0.30 or more and 0.40 or less.

10. The recording medium according to claim 1, wherein a total thickness of the ink-receiving layers containing the first ink-receiving layer and the second ink-receiving layer is 18.0 μm or more and 55.0 μm or less.

* * * * *